United States Patent [19]

Frey

[11] 4,401,233

[45] Aug. 30, 1983

[54] DISPENSER FOR SHEETS OF PAPER AND THE LIKE

[76] Inventor: Joseph V. Frey, 1111 S. Alpine Rd., Rockford, Ill. 61108

[21] Appl. No.: 245,662

[22] Filed: Mar. 20, 1981

[51] Int. Cl.[3] ..... B65H 3/20

[52] U.S. Cl. ..... 221/36; 221/45; 221/185; 221/210

[58] Field of Search ..... 221/33, 36, 39, 45, 221/185, 210, 260, 271, 259

[56] References Cited

U.S. PATENT DOCUMENTS

| | | | |
|---|---|---|---|
| 2,347,823 | 5/1944 | Goodman et al. | 221/185 X |
| 3,248,006 | 4/1966 | Lowery et al. | 221/259 X |
| 4,181,240 | 1/1980 | Luchsinger | 221/39 |

*Primary Examiner*—F. J. Bartuska

*Attorney, Agent, or Firm*—Leydig, Voit, Osann, Mayer & Holt, Ltd.

[57] ABSTRACT

A dispenser for dispensing one sheet at a time from a stack of sheets includes a hollow rectangular receptacle which receives and holds the stack and has an opening in the top wall to expose the top sheet of the stack and permit the top sheet to be removed through the opening. A lever is resiliently mounted on the receptacle adjacent the top wall and has a free end which normally extends over the opening in the top wall and which carries a pad of adhesive material on its underside. The free end of the lever may be pressed down manually to engage the pad with the top sheet of the stack and, when the free end is released, the lever returns to its normal position thereby lifting an end portion of the top sheet up through the opening where that sheet may be grasped and removed from the receptacle.

3 Claims, 3 Drawing Figures

DISPENSER FOR SHEETS OF PAPER AND THE LIKE

BACKGROUND OF THE INVENTION

This invention relates to a means for dispensing a single sheet at a time from a stack of such sheets and is particularly useful in dispensing tissue end wrap sheets such as are used in curling hair.

SUMMARY OF THE INVENTION

The general object of the invention is to provide a new and improved dispenser for sheets with which the top sheet of the stack may be removed simply and easily through the use of just one hand.

A more detailed object is to achieve the foregoing by providing the top wall of the receptacle with an opening which exposes an end portion of the top sheet of the stack and to utilize a lever which is resiliently mounted on the receptacle with its free end normally over the opening so that the free end may be pushed down through the opening and into engagement with the top sheet, the underside of the free end carrying a pad of adhesive material to which the top sheet adheres so that a portion of the top sheet is lifted through the opening and out of the receptacle when the free end is released and the lever resiliently returns to its normal position.

The invention also resides in the novel construction and arrangement of the receptacle and the lever.

DETAILED DESCRIPTION OF THE PREFERRED EMBODIMENT

Figure 3:
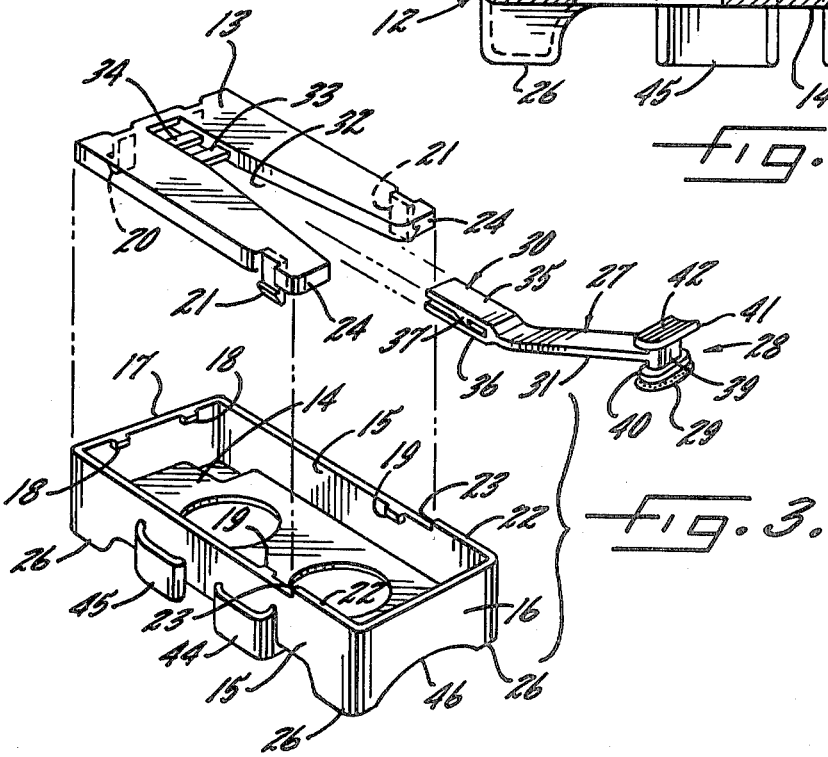
FIG. 3 is an exploded perspective view of the dispenser.

As shown in the drawings for purposes of illustration, the invention is embodied in a dispenser for retrieving individual sheets 10 from a stack 11 of sheets disposed within a receptacle 12. Although the invention is particularly useful for dispensing tissue paper sheets known as end wraps for curling hair, it may also be used for dispensing sheets of various other types. In general, the dispenser includes the hollow rectangular receptacle 12 having top and bottom walls 13 and 14, side walls 15 and front and rear end walls 16 and 17. For convenience of manufacture, the receptacle may be formed from two pieces of molded plastic material such as medium impact styrene with the bottom, end and side walls being molded as one unitary piece and the top wall being molded as the other piece as illustrated in FIG. 3.

Spaced tabs 18 project inwardly from the rear wall 17 adjacent the upper edge thereof and a similar tab 19 projects inwardly from each of the side walls 15 intermediate the ends thereof and adjacent the upper edges of these walls. Mating with the tabs 18 are hooked lugs 20 which project downwardly from the rear edge of the top wall 13 with the hook portion of each lug extending in under the corresponding tab 18 on the rear wall. Similar lugs 21 project downwardly from the side edges of the top wall to hook in under the tabs 19 on the side walls. The forward end portions 22 of the side walls 15 are somewhat higher than the remaining portions of these walls to provide rearwardly facing shoulders 23 (FIG. 3), the front wall 16 being the same height as these portions, and the top wall 13 is shorter than the bottom wall 14 and its length is such that the front edge 24 abuts the shoulders 23 when the receptacle 12 is assembled. With the top wall stopping short of and spaced from the front wall 16, these two walls cooperate to define an opening 25 (FIG. 2) through which the sheets 10 may be inserted into and removed from the receptacle. To assemble the receptacle, the front edge 24 of the top wall 13 is abutted against the shoulders 23 and then the top wall is pressed down against the upper edges of the side walls 15 and the rear wall 17, the lugs 20 and 21 resiliently yielding to pass over their respective tabs 18 and 19 and then snapping in under the tabs to hold the top wall in place. If desired, the receptacle may be molded with downwardly projecting legs 26 at the corner of the receptacle.

The present invention contemplates the provision of a novel means for simply and easily removing a single sheet 10 from the top of the stack 11 through the opening 25 in the receptacle 12 with only one hand being required to effect such removal. In general, this means comprises an elongated lever 27 resiliently mounted on the receptacle with a free end 28 normally disposed above said opening 25 but being movable into the opening and with a pad 29 of adhesive material carried on the underside of the free end of the lever. Thus, to remove the top sheet of the stack 11 from the receptacle, the free end of the lever is manually pressed down into the opening until the pad 29 is pressed against the top sheet. Then, when the lever is released, it springs back to its normal position with its free end above the opening and, because the top sheet adheres to the adhesive pad, an end portion of this sheet is lifted through the opening where it is readily grasped to remove the sheet from the receptacle.

In the present instance, the lever 27 itself is resilient and is molded as a unitary piece from a resilient plastic material such as delrin. One end portion 30 of the lever is secured to the top wall 13 of the receptacle near the rear thereof and, in the natural or normal condition of the lever, the remaining portion 31 extends upwardly and forwardly with the free end 28 disposed above the opening 25. To permit easy entry of the free end into the opening, the top wall 13 preferably is formed with an elongated centrally located slot 32 (FIG. 3) which underlies the lever portion 31 and which extends from the front edge 24 of the top wall to a point adjacent the rear of that wall. Spanning the rear end portion of the slot are two spaced ribs 33 and 34 and, forwardly of the ribs, the slot may flare somewhat as illustrated in FIG. 3.

To secure the lever 27 to the top wall 13, the rear end portion 30 of the lever comprises two flat vertically spaced legs 35 and 36 which straddle the ribs 33 and 34. The normal spacing between the legs is slightly less than the thickness of the ribs so that the legs firmly engage the ribs and a downwardly projecting finger 37 formed on the upper leg 35 abuts the back of the forward rib 33 to prevent the lever from sliding forward off the ribs. The lower leg 36 engages the underside of both ribs and the end of the upper leg 35 projects under a lip 38 (FIG. 2) on the top wall to prevent the rear portion 30 of the lever from tilting. Thus, when the free end 28 of the lever is depressed, the lever portion 31 resiliently bends downwardly through the slot 32 and the free end enters the opening 25, the lever returning to its normal position (FIG. 1) when the free end is released.

Herein, the free end 28 of the lever 27 includes a downwardly projecting part 39 which is enlarged as indicated at 40 and the pad 29 is carried on the underside of the enlargement. Preferably, the pad is made of a pliable sticky material such as butyl rubber which is molded to the shape of the enlargement 40 and is pressed against the latter to stick in place. The free end 28 also may include a finger piece 41 projecting above the lever and having a serrated upper surface 42.

Figure 1:
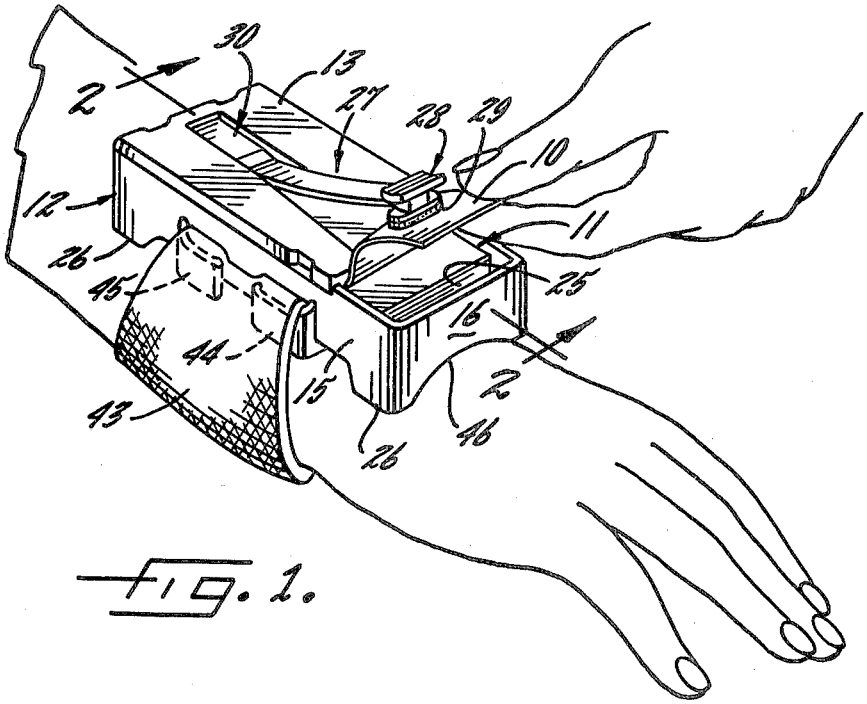
FIG. 1 is a perspective view of a dispenser embodying the present invention, the dispenser being carried on the wrist of the user by an elastic band.
Figure 2:
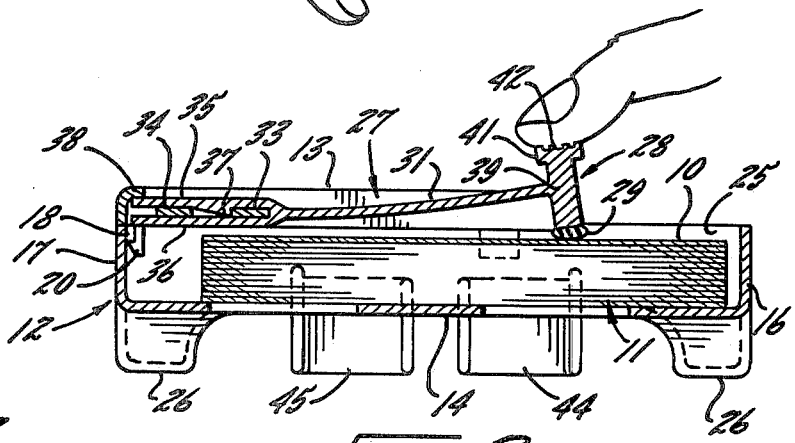
FIG. 2 is an enlarged sectional view taken along the line 2—2 in FIG. 1 but with the parts in a moved position.

With the foregoing arrangement, a stack 11 of sheets 10 is inserted into the receptacle 12 through the opening 25 and then, when it is desired to remove the top sheet, the lever 27 is depressed by manually pushing down on the finger piece 41 as shown in FIG. 2. This moves the pad 29 down through the opening 25 and into engagement with the top sheet. The latter sticks to the pad so that, when the finger piece is released, the lever springs back to its normal position and the pad carries the end portion of the top sheet up through the opening 25 as illustrated in FIG. 1. At that time, the top sheet may easily be grasped and removed from both the pad and the receptacle.

The dispenser may conveniently be carried on the wrist of the user by means of an elastic wrist band 43 (FIG. 1). For this purpose, each side wall 15 includes two hooks 44 and 45 molded integrally with the wall. The forward hook 44 extends outwardly and then rearwardly from its wall while the rear hook 45 projects outwardly and rearwardly and the two hooks are spaced apart longitudinally to permit the band to be inserted between each pair of hooks. The band then is slipped onto the user's wrist with the dispenser on top of the wrist. The lower edges of the front and rear walls 16 and 17 are arcuately concave as indicated at 46 to accommodate generally the contour of the wrist. If it is preferred not to carry the dispenser on the wrist, pads (not shown) of adhesive material such as butyl rubber may be placed on the undersides of the legs 26 so that the dispenser may be placed on a flat surface and used without slipping.

I claim:

1. A dispenser for sheets of paper and the like comprising, a rectangular receptacle having top, bottom, side and end walls and adapted to receive a stack of said sheets, said top wall stopping short of the front end of said receptacle to provide an opening exposing a portion of the top sheet of said stack, an elongated slot centrally formed in said top wall and extending rearwardly from said opening to a point adjacent the rear end of said receptacle, at least one transverse abutment extending across said slot adjacent the rear end thereof, an elongated lever formed as a single piece of resilient plastic and disposed in said slot, the rear end portion of said lever being formed by vertically spaced legs straddling said abutment, a finger formed on one of said legs and engaging said abutment thereby mounting said lever on said top wall, the forward portion of said lever normally extending upwardly to position the forward free end of the lever above said top wall and over said opening, said free end including a downwardly projecting portion, and a pad of adhesive material mounted on the underside of said downwardly projecting portion to adhere to the top sheet of said stack when said free end of said lever is pushed down through said opening, said pad being operable when said free end is released and the forward end of said lever returns to its normal position to lift the end portion of said top sheet through said opening where it may be grasped and removed from said receptacle.

2. A dispenser as defined in claim 1 including coacting surfaces formed on said top and the rear end portion of said lever and operable to prevent said rear end portion from tilting as said free end portion of the lever is pushed down through said opening.

3. A dispenser as defined in claim 2 in which said bottom, side and end walls are molded as a first unitary piece of plastic material and said top wall is molded as a second unitary piece of plastic material and including first and second locking means formed respectively on said first piece and said second piece and resiliently coacting with each other to permit said second piece to be snapped onto and held in place on said first piece.

* * * * *